US007066127B2

(12) United States Patent
Flanagan et al.

(10) Patent No.: US 7,066,127 B2
(45) Date of Patent: Jun. 27, 2006

(54) CONTROLLED ENGINE CAMSHAFT STOPPING POSITION

(75) Inventors: Jason W. Flanagan, Rochester, NY (US); Timothy W. Kunz, Rochester, NY (US); Wayne S. Harris, Hilton, NY (US); Thomas H. Fischer, Rochester, NY (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 10/895,533

(22) Filed: Jul. 21, 2004

(65) Prior Publication Data

US 2006/0016411 A1 Jan. 26, 2006

(51) Int. Cl.
*F02D 45/00* (2006.01)

(52) U.S. Cl. ..... 123/179.4; 123/198 R

(58) Field of Classification Search ..... None
See application file for complete search history.

(56) References Cited

U.S. PATENT DOCUMENTS 5,117,790 A * 6/1992 Clarke et al. ..... 123/198 F
6,218,799 B1 * 4/2001 Hori ..... 318/446
6,647,955 B1 * 11/2003 Sieber ..... 123/179.3

FOREIGN PATENT DOCUMENTS

WO WO 01/44636 A2 * 6/2005

* cited by examiner

*Primary Examiner*—Andrew M. Dolinar
(74) *Attorney, Agent, or Firm*—Jimmy L. Funke

(57) ABSTRACT

A system for bringing an internal combustion engine to a stop at a predetermined angular position of an engine shaft, such as a crankshaft or a camshaft, with respect to the engine's valves. The optimum shaft stop position is the point wherein the fewest lifters are collapsed the least amount. Exemplary methods and apparatus include using the engine starter motor to jog the stopped engine to the desired position; using the engine alternator to impose a variable electromagnetic load on the engine to bring the engine to a stop at the desired position; using variable firing of cylinders to control the deceleration profile to bring the engine to a stop at the desired position; and providing one or more detents formed in the shaft and using a shaft follower to control the stop position of the shaft by engaging the follower into a detent.

13 Claims, 2 Drawing Sheets

CONTROLLED ENGINE CAMSHAFT STOPPING POSITION

TECHNICAL FIELD

The present invention relates to internal combustion engines; more particularly, to camshafts or crankshafts in internal combustion engines; and most particularly, to a method and apparatus for stopping the shaft at a predetermined angular position when the engine is shut off.

BACKGROUND OF THE INVENTION

Internal combustion engines having intake and exhaust valves are well known. A typical internal combustion engine includes at least one camshaft having lobes for opening and closing the valves. In some engines, separate camshafts are provided for the intake and exhaust valves; thus each of the twin camshafts has only half of the total number of cam lobes.

In modern internal combustion engines, each valve train typically includes a hydraulic valve lifter (HVL) for automatically eliminating mechanical lash in the valve actuating mechanism. A spring urges a piston outwards to eliminate lash, and in response the piston chamber fills with oil via a check valve. Although oil can slowly enter and leave the piston chamber, during any relatively short period of engine operation, for example, one or a few revolutions, the HVL is hydraulically rigid.

A condition can arise when an engine is shut down, in that some valves are left in the open position with the full pressure of the valve closing spring brought to bear against the corresponding HVL. Over time, when the engine is not running, the oil in the HVL chamber is forced out as the piston assumes a compliant position. When the engine is restarted, the piston chamber will be refilled as engine control is re-established and the engine oil supply pressure increases, but for the first few seconds of operation, the deflated HVL can be objectionably noisy (known in the art as "cold start noise") and can also cause excessive engine wear. This problem is aggravated by the trend in the HVL art to smaller piston chambers, having lower reservoir volumes, to reduce the overall size of the lifters. In addition, special HVLs for use in valve deactivation on some engines have especially small piston chambers and are therefore especially vulnerable to leakdown under stopped, valve-open load.

In prior art engines, the position of the engine when it stops is essentially random; that is, there is no mechanically or electronically favored angular position of the crankshaft or camshafts after the engine is shut off and coasts to a rotational stop. The number of valves open and degree of valve opening at engine stop depend upon engine configuration, i.e., L4, V6, V8, etc., as well as the number of camshafts and the cylinder firing order. However, some angular positions are favored over others. For example, for the purpose of reducing cold start noise, it is desirable to bring the engine to a stop position where none of the engine valves are at full open position. Hence, if an optimal angular position can be determined, then it is desirable to be able to bring the engine to a stop at that position at every shutdown.

It is a principal object of the present invention to minimize the number of valves left open and the degree of valve opening at every shutdown of an internal combustion engine, and thereby minimize cold start noise upon restarting of the engine.

SUMMARY OF THE INVENTION

Briefly described, the invention is directed to means for bringing an internal combustion engine to a stop at a predetermined angular orientation of the crankshaft and camshafts. For the purpose of reducing cold start noise, the optimum stop position of the camshaft(s), wherein a minimum of valve opening occurs, can be readily determined from an examination of an individual camshaft and the angular orientations of all lobes. A cam timing diagram can show the point wherein the fewest lifters are collapsed the least amount.

Prior art engines are equipped with crankshaft and camshaft sensors that are used to calculate the instantaneous camshaft rotation position, especially those engines further equipped with means for deactivating the action of some of the valves as is known to be desirable under some operating conditions. Therefore, what is needed is a means for bringing an engine to a stop at the optimum engine camshaft angular position, as measured by the camshaft and/or crankshaft position sensors.

Any of several methods may be used, either separately or in combination. All of these methods presume the availability and incorporation of a programmable Engine Control Module (ECM), examples of which are well-known on automotive vehicles in the prior art.

Exemplary methods and apparatus include, but are not limited to:

a) using the engine starter motor to jog the stopped engine to the desired position;

b) using the engine alternator to impose a variable electromagnetic load on the engine as it decelerates, to bring the engine to a stop at the desired position;

c) using variable firing of cylinders to control the deceleration profile to bring the engine to a stop at the desired position;

d) providing one or more detents formed in the camshaft or crankshaft or an attached wheel and using a spring- or solenoid-loaded shaft follower to control the stop position of the camshaft by engaging the follower into the detent.

BRIEF DESCRIPTION OF THE DRAWINGS

The present invention will now be described, by way of example, with reference to the accompanying drawings, in which.

DESCRIPTION OF THE PREFERRED EMBODIMENTS

Figure 1:
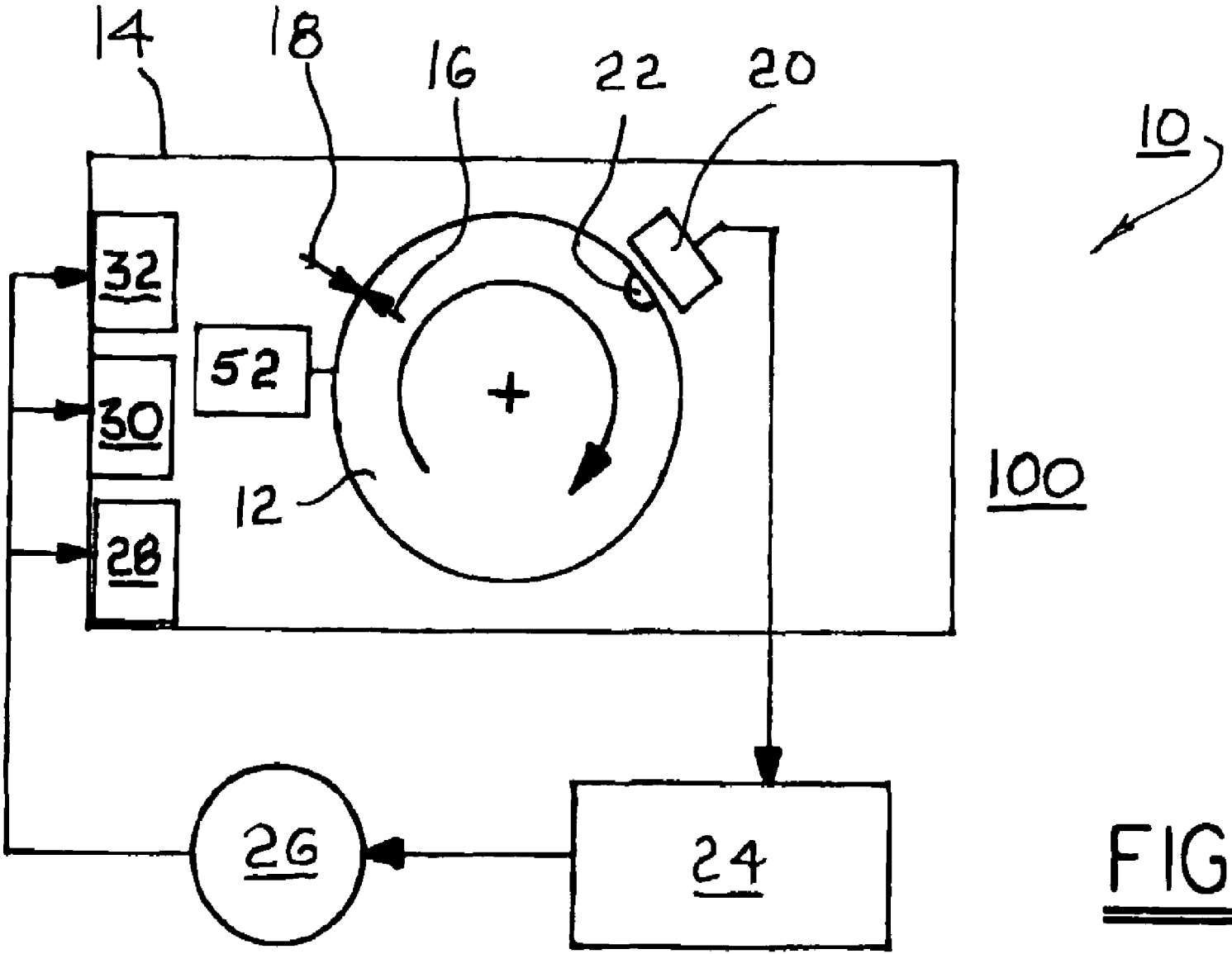
FIG. 1 is a generic schematic drawing of an engine shaft positioning system in accordance with the invention.

Referring to FIG. 1, a system 10 is shown for positioning an engine shaft 12, such as a crankshaft or a camshaft of an internal combustion engine 14 at a predetermined rotational position 16 of the camshaft with respect to a position 18 of the engine (and in particular, the engine's valves operated by the camshaft) when the engine stops rotation after being shut down. A shaft position sensor 20 monitors the rotary position of a target 22 on the shaft and sends that information to a programmable electronic engine control module (ECM) 24. ECM 24 is programmed such that, during stopping of engine 14, ECM 24 engages and controls shaft positioning mechanism 26 to cause shaft position 16 to stop opposite engine position 18.

In a first exemplary embodiment, as engine 14 is shut down and shaft 12 comes to rest, its angular position is known as determined by sensor 20 and target 22. If the position is as desired (position 16 corresponds to position 18, defining a correct stopping position 16/18), the shutdown is complete. If engine 14 needs to be rotated through a partial cycle to reach such correspondence, engine starter motor 28 may be engaged in known fashion by ECM 24, powered by an engine battery or fuel cell, and the engine rotated until the proper orientation is obtained. Starter motor 28 is then disengaged. For this embodiment, starter motor 28 should be considered part of positioning mechanism 26.

In a second exemplary embodiment, as engine 14 begins to decelerate after ignition cut-off, alternator 30 may be instructed by ECM 24 to impose a mechanical load on the engine by temporarily increasing charging rates, effectively damping the engine inertia electromagnetically. ECM 24 is programmed to vary the load, using feedback from shaft sensor 20 to bring engine 14 to a stop at precisely the desired angular stopping position 16/18 of the shaft. In this embodiment, alternator 30 should be considered part of positioning mechanism 26.

In a third exemplary embodiment, ECM 24 senses via sensor 20 the rate of decay of rotational velocity of engine 14 after ignition cut-off and makes a forward calculation as to what the final angular position of shaft 12 will be. The selective firing of engine cylinders 32, utilizing the vehicle's ignition and fuel system in conjunction with ECM 24, may be used to adjust the expected stopping position to the desired stopping position. As the engine speed becomes very low, opposed cylinders may be fired simultaneously to stop engine 14 at the correct angular stopping position 16/18. In this embodiment, the firing of selected engine cylinders 32 should be considered part of positioning mechanism 26.

Figure 2:
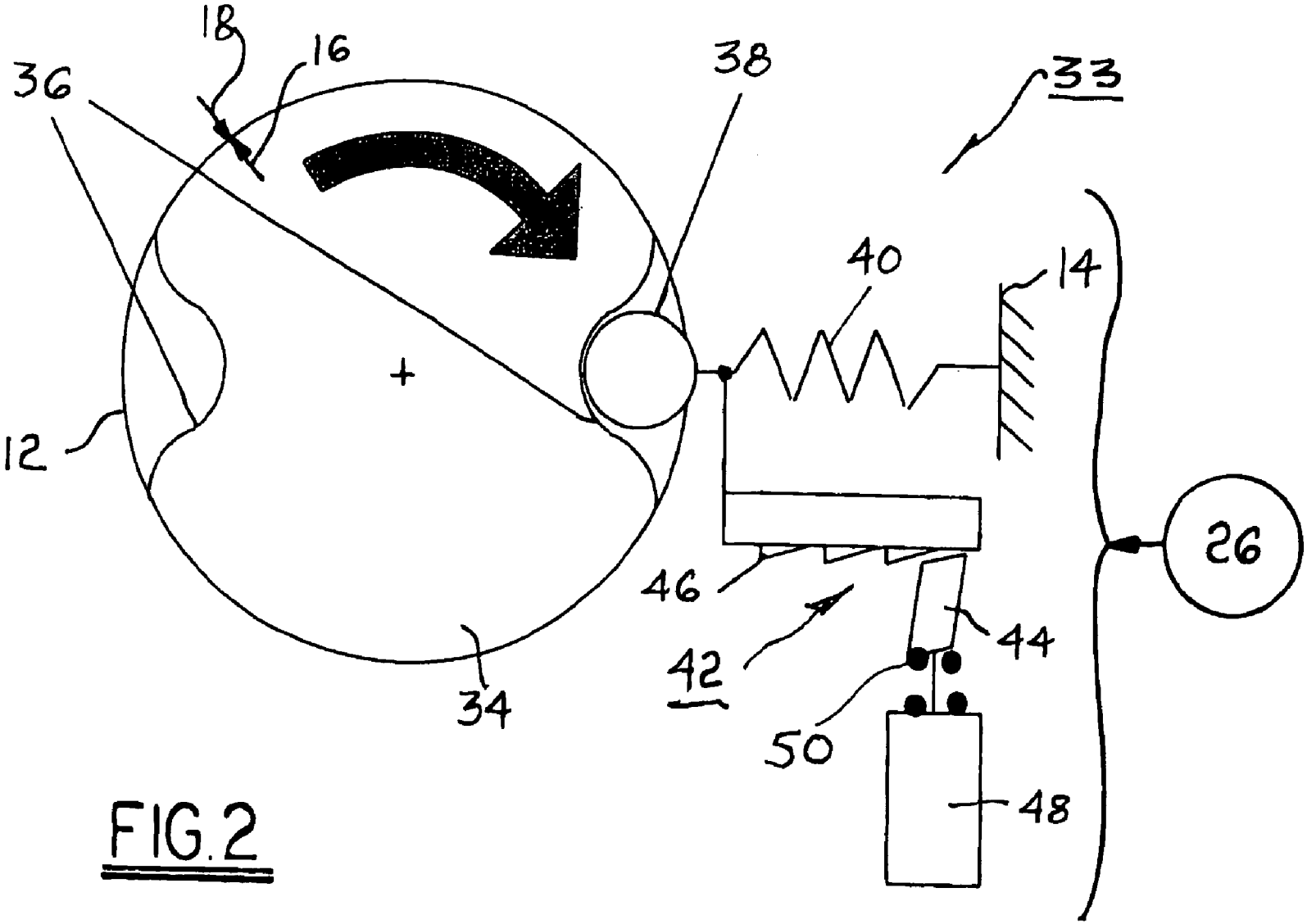
FIG. 2 is a schematic drawing of an exemplary embodiment of a system in accordance with the invention.

Referring to FIG. 2, a fourth exemplary embodiment is shown schematically in detail. Shaft 12, which may be a crankshaft or a camshaft, is provided with an attached wheel 34 having at least one detent 36, the number of detents depending on the engine configuration. Alternatively, detents 36 may be formed directly in the surface of shaft 12 itself. A follower 38 is disposed adjacent wheel 34 at an angular location such that, when follower 38 engages detent 36, shaft 12 is in correct stopping position 16/18. Follower 38 is biased by spring 40 against wheel 34 to find detent 36, thus positioning shaft 12 in correct position 16/18. Follower 38 is also attached to ratchet 42 which includes a pawl 44 selectively engageable with rack 46 by biasing spring 50. Upon engine restart, follower 38 is urged out of detent 36 by rotation of camshaft 12. The outward movement of follower 38 simultaneously moves rack 46 and ratchet 42 to engage pawl 44, thus holding follower 38 from re-engagement with detent 36 during operation of engine 14. When engine 14 is shut off, solenoid 48 is momentarily energized, thereby retracting pawl 44 against spring 50, and follower 38 is again urged by spring 40 to engage with detent 36, eventually causing engine 14 and camshaft 12 to stop in the correct position 16/18. Solenoid 48 is then de-energized and pawl 44, biased by spring 50, is ready to re-engage ratchet 42 upon engine restart.

The invention is especially useful for use in an internal combustion engine used to power a vehicle 100.

The invention is also especially useful in combination with a variable valve activation (VVA) system, shown schematically as numeral 52, which systems are well known in the engine arts. For example, on some V-style engines, the valves in one engine bank may be closed by correct 16/18 positioning of the corresponding camshaft after engine shutdown, and the valves in the other bank may be deactivated by system 52, thus relieving all the hydraulic lifters from valve spring pressure.

While this invention is described as useful in stopping an engine at a predetermined position for the purpose of reducing cold start noise upon restart, it is understood that the invention is useful for other purposes such as, for example, stopping the engine for optimum restart for improved fuel economy or emissions, for improving engine durability, etc. In an application for improved fuel economy or emissions, the ECM does not have to wait to read the angular position of the crankshaft or camshaft at engine start in order to set engine control parameters such as spark timing, fuel rate, or fuel timing. Since the angular position is known before engine start, the engine control parameter settings can be correctly calibrated for quick engine start and immediate control for optimized combustion.

This invention is also useful for improved fuel economy in hybrid engine applications.

While the invention has been described by reference to various specific embodiments, it should be understood that numerous changes may be made within the spirit and scope of the inventive concepts described. Accordingly, it is intended that the invention not be limited to the described embodiments, but will have full scope defined by the language of the following claims.

What is claimed is:

1. A system for causing an engine shaft in an internal combustion engine to stop after engine shutdown at a predetermined angular position of the shaft with respect to the engine's valves, said system comprising:

a) a sensor for sensing the angular position of said shaft;

b) a programmable electronic engine control module in electrical communication with said sensor; and c) a shaft positioning mechanism responsive to said engine control module for causing said shaft to stop at said predetermined angular position, said shaft positioning mechanism comprising at least one detent associated with said shaft and a follower disposed adjacent said detent for selectively engaging therewith to stop said shaft in said predetermined position.

2. A system in accordance with claim 1 wherein said shaft positioning mechanism includes an electric motor engageable with said engine.

3. A system in accordance with claim 2 wherein said electric motor is a starter motor for said engine.

4. A system in accordance with claim 1 wherein said shaft positioning mechanism includes an alternator for said engine.

5. A system in accordance with claim 1 wherein said shaft positioning mechanism includes at least one selected combustion cylinder of said engine.

6. A system in accordance with claim 1 further comprising a variable valve activation system.

7. A system in accordance with claim 1 wherein said engine shaft is selected from a group consisting of a crankshaft and a camshaft.

8. A method for causing a shaft in an internal combustion engine to a stop at a predetermined angular position of the shaft with respect to the engine valves, said method comprising the steps of:

a) providing a sensor for sensing the angular position of said shaft;

b) providing a programmable electronic engine control module in electrical communication with said sensor;

c) providing a shaft positioning mechanism responsive to said engine control module for causing said shaft to stop at said predetermined angular orientation, said shaft positioning mechanism comprising at least one detent associated with said shaft and a follower disposed adjacent said detent for selectively engaging therewith to stop said shaft in said predetermined position; and d) engaging said detent with said follower to cause said shaft to stop at said predetermined angular position.

9. A method in accordance with claim 8 wherein said shaft positioning mechanism includes a starter motor for said engine.

10. A method in accordance with claim 8 wherein said shaft positioning mechanism includes an alternator for said engine.

11. A method in accordance with claim 8 wherein said shaft positioning mechanism includes at least one combustion cylinder of said engine.

12. A vehicle comprising an internal combustion engine including a system for causing an engine shaft in said engine to a stop at a predetermined angular orientation of said shaft with respect to the engine's valves, said system including:

a) a sensor for sensing the angular position of said shaft;

b) a programmable electronic engine control module in electrical communication with said sensor, and c) a shaft positioning mechanism for causing said shaft to stop after engine shutdown at said predetermined angular orientation, said shaft positioning mechanism comprising at least one detent associated with said shaft and a follower disposed adjacent said detent for selectively engaging therewith to stop said shaft in said predetermined position.

13. A method for reducing cold start engine noise when starting an internal combustion engine, comprising the steps of:

a) determining an optimum rotational position of an engine shaft in said engine wherein the number of valves open and the degree of valve opening is optimized, and wherein leakdown of hydraulic valve lifters associated with said open valves is optimized during shutdown periods of said engine; and b) causing said shaft to stop at said optimum rotational position when said engine is shut down by selectively engaging at least one detent associated with said shaft to a follower disposed adjacent said detent.

* * * * *